US009386370B2

(12) United States Patent
Nielsen et al.

(10) Patent No.: US 9,386,370 B2
(45) Date of Patent: Jul. 5, 2016

(54) SLEW RATE CONTROL APPARATUS FOR DIGITAL MICROPHONES

(71) Applicant: Knowles Electronics, LLC, Itasca, IL (US)

(72) Inventors: John Nielsen, Hillerød (DK); Claus Erdmann Fürst, Himmelev (DK); Aziz Yurttas, København S (DK); Anders Svava Mortensen, Køge (DK)

(73) Assignee: Knowles Electronics, LLC, Itasca, IL (US)

( * ) Notice: Subject to any disclaimer, the term of this patent is extended or adjusted under 35 U.S.C. 154(b) by 7 days.

(21) Appl. No.: 14/468,709

(22) Filed: Aug. 26, 2014

(65) Prior Publication Data

US 2015/0063594 A1 Mar. 5, 2015

Related U.S. Application Data

(60) Provisional application No. 61/873,572, filed on Sep. 4, 2013.

(51) Int. Cl.
*H04R 3/00* (2006.01)

(52) U.S. Cl.
CPC ..... *H04R 3/00* (2013.01)

(58) Field of Classification Search
None
See application file for complete search history.

(56) References Cited

U.S. PATENT DOCUMENTS 4,642,629 A * 2/1987 Milligan ..... G06F 13/4226 340/14.1
5,567,863 A 10/1996 Larson et al.
6,285,769 B1 * 9/2001 Edelson ..... H04R 3/002 381/111
6,438,178 B1 * 8/2002 Lysdal ..... H04L 25/03885 327/307
6,813,325 B1 * 11/2004 Lin ..... H04J 3/0647 375/293
8,687,823 B2 4/2014 Loeppert et al.
9,059,630 B2 6/2015 Gueorguiev et al.
9,111,548 B2 8/2015 Nandy et al.
2002/0150392 A1 * 10/2002 Yoo ..... H04N 5/775 386/263
2003/0086518 A1 * 5/2003 Chakravarthy ..... H03L 7/0992 375/359
2006/0126865 A1 6/2006 Blamey et al.
2006/0261789 A1 * 11/2006 May ..... G05F 1/56 323/274
2007/0067651 A1 * 3/2007 May ..... G06F 1/28 713/300
2008/0021706 A1 1/2008 Bruwer
2011/0013792 A1 1/2011 Iwano et al.
2014/0177113 A1 6/2014 Gueorguiev et al.
2014/0197887 A1 7/2014 Hovesten et al.
2015/0058001 A1 2/2015 Dai et al.

(Continued)

FOREIGN PATENT DOCUMENTS

JP 2006287752 A 10/2006

OTHER PUBLICATIONS

International Search Report and Written Opinion for PCT/US2014/052938 dated Dec. 12, 2014 (9 pages).

*Primary Examiner* — Peter Vincent Agustin
(74) *Attorney, Agent, or Firm* — Foley & Lardner LLP

(57) ABSTRACT

A driver, includes a driver block, a controller block, and a comparison block. The driver block includes an adjustable current source configured to produce a digital output stream. The controller block is coupled to the driver block. The comparison block is coupled to the driver block and the controller block. The comparison block is configured to compare the digital output stream to a reference value at a time delayed with respect to a master clock and based upon the comparison cause the controller block to adjust a strength of the driver block.

14 Claims, 3 Drawing Sheets

(56) References Cited

U.S. PATENT DOCUMENTS

| | | | | |
|---|---|---|---|---|
| 2015/0063594 | A1* | 3/2015 | Nielsen | H04R 3/00 381/98 |
| 2015/0256916 | A1 | 9/2015 | Volk et al. | |
| 2015/0350760 | A1 | 12/2015 | Nandy et al. | |
| 2015/0350774 | A1 | 12/2015 | Furst et al. | |
| 2016/0012007 | A1 | 1/2016 | Popper et al. | |

* cited by examiner

SLEW RATE CONTROL APPARATUS FOR DIGITAL MICROPHONES

CROSS REFERENCE TO RELATED APPLICATION

This patent claims benefit under 35 U.S.C. §119 (e) to U.S. Provisional Application No. 61873572 entitled "Slew rate control apparatus for digital microphones" filed Sep. 4, 2013, the content of which is incorporated herein by reference in its entirety.

TECHNICAL FIELD

This application relates to microphones and, more specifically, to improving the slew rate characteristics of the output drivers associated with these microphones.

BACKGROUND OF THE INVENTION

In recent years digital microphones has becoming increasingly popular in portable electronic equipment and, in particular, as used with mobile phones. One advantage of digital microphones is their inherent property of being very immune to modulated RF signals, both radiated and conducted.

For example, microphones are typically placed in close vicinity to radio transmitters, i.e., the antenna, in many mobile phones. Previously, analog microphones have been used in mobile phones, but these are quite susceptible to modulated RF signals such as noise coming from the antenna. In an analog microphone the modulated RF signal is demodulated into an unwanted audio signal.

Digital microphones do not face many of the same demodulation issues or concerns as analog microphones. For instance, the immunity of digital microphones towards modulated RF signals opens the possibility of placed in close proximity to the antenna. However, this displacement creates new problems.

More specifically, the antenna of a typical mobile phone is not only used to transmit RF signals but also used to receive RF signals. The received RF signals are often very small, e.g., approximately −140 dBm, and thus are very sensitive to interfering signals.

As the output signal from the digital microphone is digital, then the output signal will have very steep edges (e.g., nS) and thus the frequency content of the signal reaches into several hundreds of MHz (and sometimes into the GHz range). This creates interference problems for the circuit.

BRIEF DESCRIPTION OF THE DRAWINGS

For a more complete understanding of the disclosure, reference should be made to the following detailed description and accompanying drawings wherein.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

In the present approaches, the steepness of the edges created by a driver circuit for a digital output stream of a microphone is adaptively controlled by an active circuit that compensates for variances in load capacitance, production tolerances, and other factors. In some aspects, a control loop is utilized and this control loop varies the strength of the output driver. By "strength" and as used herein, it is meant drive capability. The varying of the strength is based in some aspects only upon digital feedback from the output of the driver and a controlled delay. In other aspects, an output driver is provided where the drive strength is controlled by a feedback loop assuring that the digital output signal settles with predetermined value given from a reference voltage.

In some examples, the output of the driver is sampled at a predetermined time after the reference clock changes and is then compared to a data signal that is received by the output buffer. If the output signal has not settled, then these two signals will be different. Consequently, the drive strength of the output buffer will be increased. If the two signals are equal, then the drive strength will be decreased and the output signal will then settle slower. The feedback loop will then, over time, assure that the settling time (over time and depending of the loop bandwidth of the regulation loop) approaches the desired settling time. It will be appreciated that from clock sample to clock sample, the settling time will vary but this has no detrimental effect. In other words, the desired settling time can be set with some margin or the feedback loop can be restricted to operate during a power up sequence and the obtained driver strength settings can then be stored in a register or other memory storage devices.

Figure 1:
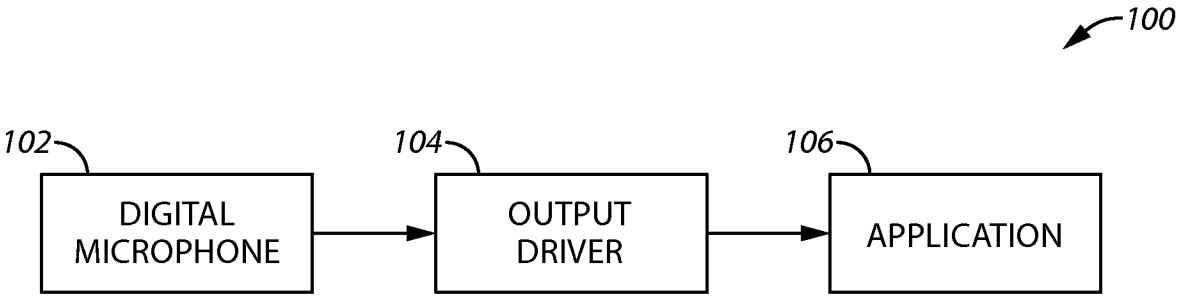
FIG. 1 comprises a block diagram of a system including a slew rate control apparatus according to various embodiments of the present invention.

Referring now to FIG. 1, one example of a system 100 that includes slew rate control is described. The system includes a digital microphone 102 (with digital output 103), an output driver 104 (with a digital output stream 105), and an application (load) 106. By "slew rate" and as used herein, it is meant output settling slope.

The digital microphone 102 may be any example of a digital microphone. The digital microphone 102 receives a voice signal and converts the voice signal to a digital signal that is presented at its output.

The output driver 104 adaptively controls the steepness of the edges of the output stream 105 by, in one example, using an active circuit that compensates for variances in the capacitance, production tolerances and/or other characteristics of the application 106. In some aspects, the output driver uses a control loop that is based only on digital feedback and a controlled delay. In other aspects, an output driver 104 is provided where the drive strength is controlled by a feedback loop assuring that the digital output signal settles with predetermined value given from a reference voltage. The structure and operation of example output drivers are described further below.

The application 106 is any type of application or load that utilizes the digital stream 105. In this respect, it may include various electrical and electronic components such as resistors and capacitors. Additionally, the application may include any type of processing capability and may be a part of another device (e.g., a component of a cellular phone or a computer to mention two examples).

Figure 2:
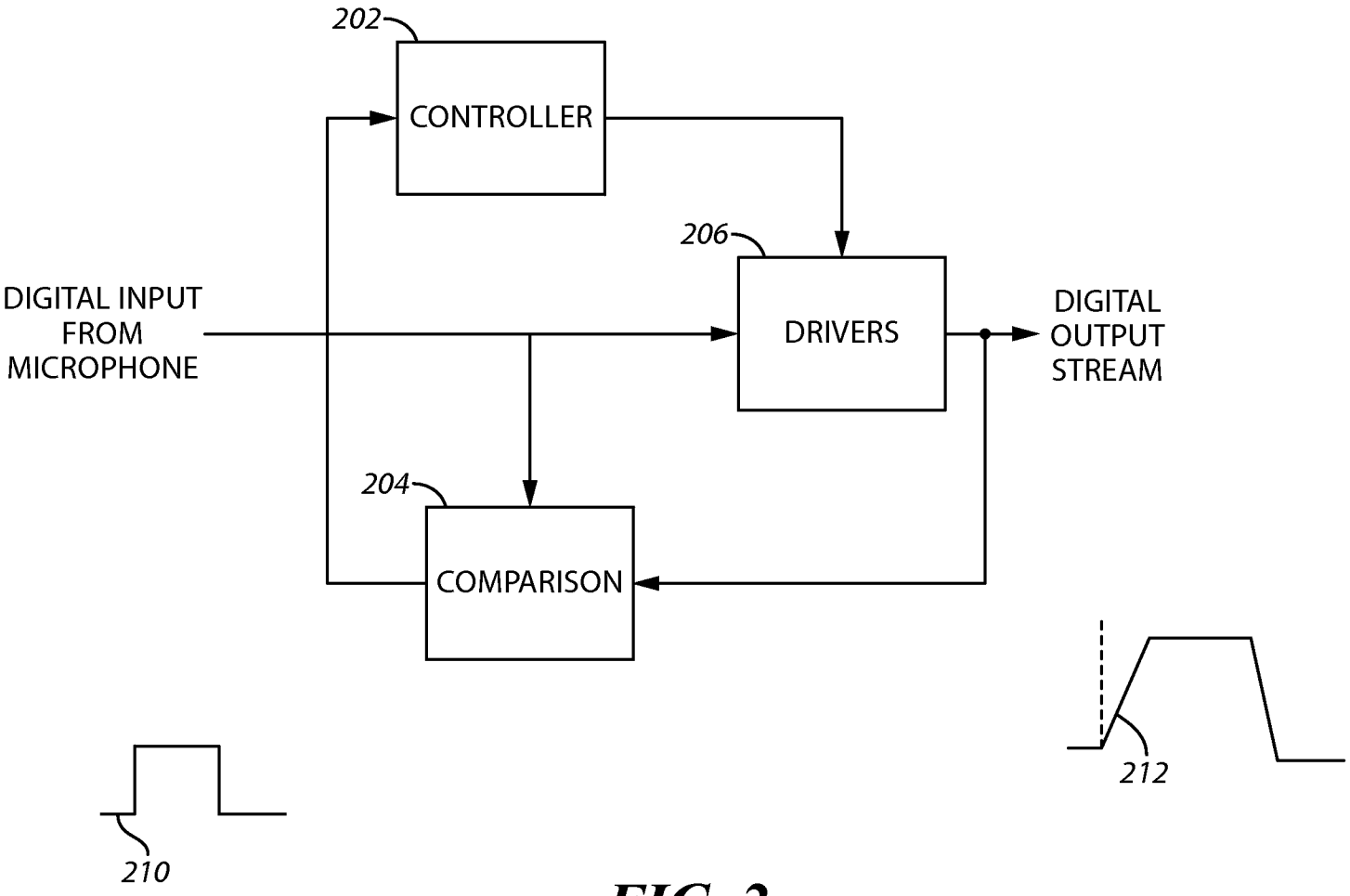
FIG. 2 comprises a slew rate control driver according to various embodiments of the present invention.

Referring now to FIG. 2, a functional block diagram of an output driver 200 is described. The driver 200 includes a controller block 202, a comparison block 204, and a driver block 206. It will be appreciated that these blocks can be constructed of various types of circuits and/or programmed devices.

The controller block 202, in one example, is an up/down counter. The comparison block 204 compares the feedback signal to a reference signal and produces signals for the controller. The driver block 206 includes adjustable current sources that produce the digital output stream.

In one example of the operation of the system of FIG. 2, the comparison block 204 compares the digital output stream against a reference value at a time delayed with respect to a master clock. The delay represents when it is desirable for the output to settle (e.g., approximately 100 ns after the master clock shifts in one example). The comparison determines if the output at this specific time is either high or low compared to the reference. The result of the comparison is then fed to the controller block 202. Controller block will then either increase or decrease the strength of the drivers 206 depending on whether the output stream settles slow or fast.

It will be appreciated that the digital input from the microphone (shown in the waveform labeled 210) may be square-wave like. However, using the approaches described herein, the digital output stream may have waveforms with less steep edges (for example, as shown by the waveform labeled 212).

Figure 3:
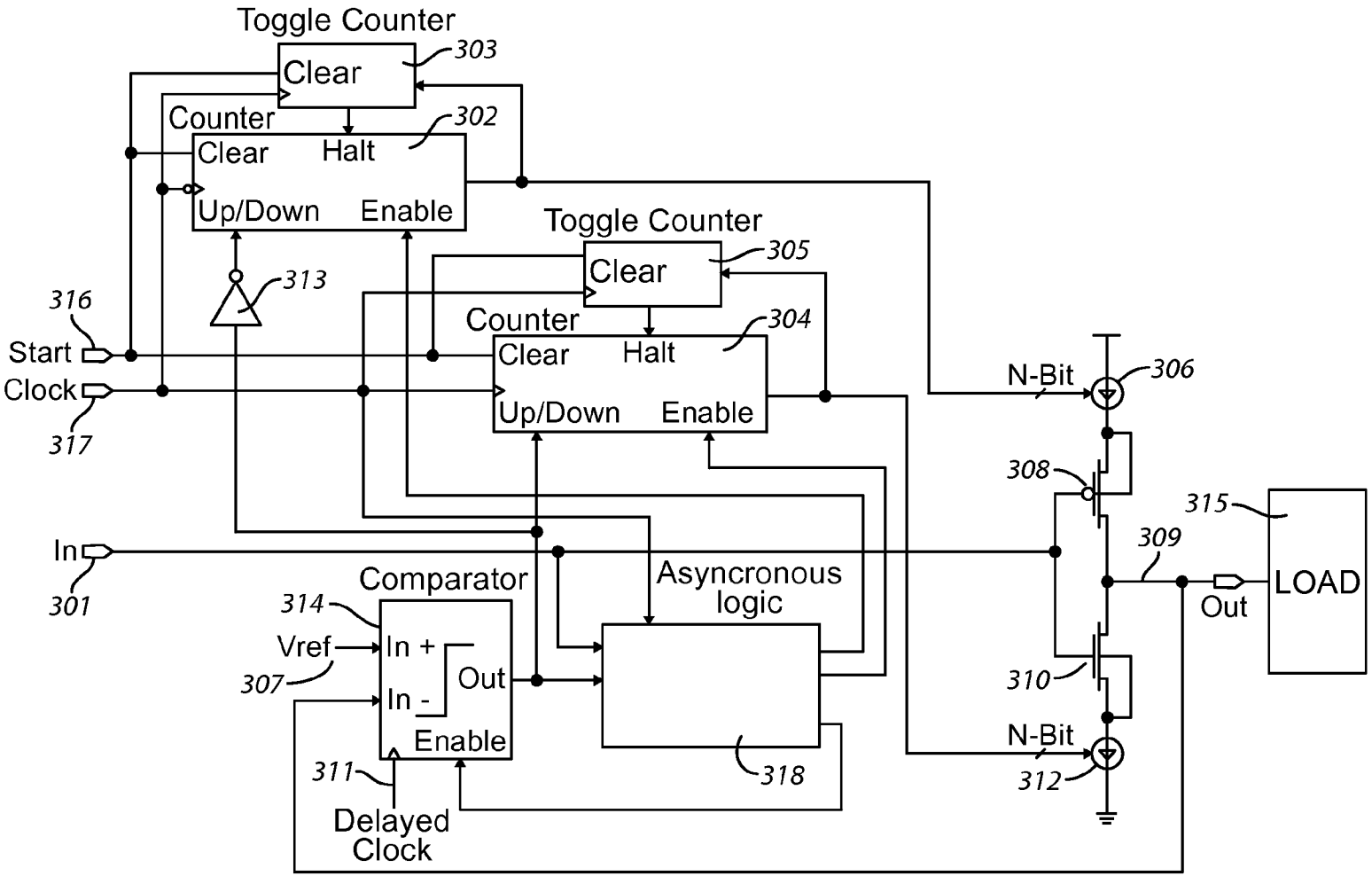
FIG. 3 comprises a slew rate control driver circuit according to various embodiments of the present invention.

Referring now to FIG. 3, one example of a driver circuit 300 is described. The driver circuit 300 (e.g., the output driver 104 of FIG. 1 or output driver 200 of FIG. 2) includes an up/down counter 302 for current source, up/down counter 304 for current sink, a toggle counter 303 controlling 302, another toggle counter 305 controlling 304, an adjustable current source 306 and an adjustable current sink 312, a first transistor 308, a second transistor 310, a comparator 314, an asynchronous logic circuit controlling 302, 304, and 314. These components are well known to those skilled in the art and their further structure will not be described further herein.

The output driver 300 provides control for the digitally adjustable current source 306 and digitally adjustable current sink 312. The comparator 314 samples the output signal with a clock delay signal 311 (the delay with respect to a master clock). The asynchronous logic with the sampled signal from the comparator 314, in response, controls the up/down counters 302 and 304 together with the comparator 314. Asynchronous logic controls which of the counters of 302 or 304 is to be enabled and furthermore ensures that any of the two counters together with the comparator runs only when there is a logic state transition at the input 301

The up/down counter 302 produces N bits that control the drive strength of the current sink 306, and the up/down counter 304 produces N bits that control the drive strength of the current source 312. The current source 306 sources the current provided to a load 315 and the current sink 312 sinks the current provided from the load 315.

In operation, the output 309 of the driver circuit 300 is compared against a reference voltage value 307 at a time that is delayed with respect to the master clock. This delay represents the time when it is desirable for the output 309 to settle (e.g., approximately 100 ns after the master clock shifts). The comparator 314 will then determine if the output 309 at this specific time is either high or low compared to the reference voltage value 307. Based on the result of the comparison together with the logic state of the input 301, the asynchronous logic 318 determines which counter is to subject to change and whether the counter value should be increased or decreased. If the counter value is increased, the drive strength of the corresponding current source/sink will increase meaning faster settling at the next clock. On the other hand, if the counter value is decreased, the regulation loop will instead decrease the value of the respective counter and, consequently, the drive strength of the corresponding current source/sink will decrease meaning slower settling.

The example output driver of 300 can be kept running for a limited amount of time based on the assumption that the load of 315 is constant and not subject to change. In this manner, the circuit consisting of the counters, comparator and asynchronous logic is kept running for a time guaranteeing the counter output are at the right values, and then get disabled. Disabling ensures the counter values are halted to the final values. In one example, this operation can be done by use toggling counter that checks the number of toggling at the relevant counter output, and then disables the respective counter when the number of toggling reaches a preprogrammed value. Toggling counter 303 counts the toggling at counter 302 and halts 302, and toggling counter 305 counts the toggling at counter 304 and halts 304. Another example can be where the overall operation is controlled by an external circuit like a digital processor or controller.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A driver, the driver comprising:

a driver block, the driver block including an adjustable current source configured to produce a digital output stream;

a controller block coupled to the driver block;

a comparison block coupled to the driver block and the controller block, the comparison block configured to compare the digital output stream to a reference value at a time delayed with respect to a master clock and based upon the comparison cause the controller block to adjust a strength of the driver block.

2. The driver of claim 1, wherein controller block comprises a counter.

3. The driver of claim 1, wherein the digital output stream comprises a square waveform.

4. The driver of claim 1, wherein the digital output stream comprises a modified square wave form with a slanted edge.

5. The driver of claim 1, wherein the delay represents a time desirable for the output of the driver to settle.

6. The driver of claim 1, wherein the driver strength is increased, the increase being effective to increase a setting time of the digital output stream at a next clock.

7. The driver of claim 1, wherein the driver strength is decreased, the decrease being effective to decrease a settling time of the digital output stream at a next clock.

8. A method of controlling a driver, the method comprising:

comparing, by a comparator circuit of the driver, a digital output stream of a driver to a reference value at a time delayed with respect to a master clock;

based upon the comparing, causing, by an asynchronous circuit of the driver, an adjustment of a strength of the driver, the strength being a capability of the driver, the adjustment being effective to alter a settling of the digital output stream.

9. The method of claim 8, wherein the digital output stream comprises a square waveform.

10. The method of claim 8, wherein the digital output stream comprises a modified square waveform with a slanted edge.

11. The method of claim 8, wherein the delay represents a time desirable for the output of the driver to settle.

12. The method of claim 8, wherein the adjustment is an increase in the drive strength, the increase in the drive strength being effective to increase a settling time of the digital output stream at a next clock.

13. The method of claim 8, wherein the adjustment is a decrease in the drive strength, the decrease in the drive strength being effective to decrease a settling time of the digital output stream at a next clock.

14. The method of claim 8, wherein a settling time of the digital output stream varies from clock cycle to clock cycle.

* * * * *